US008295740B2

(12) United States Patent
Ohkawa et al.

(10) Patent No.: US 8,295,740 B2
(45) Date of Patent: Oct. 23, 2012

(54) DEVELOPING DEVICE, IMAGE FORMING APPARATUS, AND CLEANING METHOD FOR THE DEVELOPING DEVICE

(75) Inventors: Takeshi Ohkawa, Osaka (JP); Mitsuru Tokuyama, Osaka (JP); Motoyuki Itoyama, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 296 days.

(21) Appl. No.: 12/695,363

(22) Filed: Jan. 28, 2010

(65) Prior Publication Data

US 2010/0196056 A1 Aug. 5, 2010

(30) Foreign Application Priority Data

Jan. 30, 2009 (JP) ..... P2009-020999

(51) Int. Cl.
*G03G 15/08* (2006.01)

(52) U.S. Cl. ..... 399/254

(58) Field of Classification Search ..... 399/254, 399/264

See application file for complete search history.

(56) References Cited

U.S. PATENT DOCUMENTS

2007/0046408 A1* 3/2007 Shim ..... 335/296

FOREIGN PATENT DOCUMENTS

| | | |
|---|---|---|
| JP | 3-170975 | 7/1991 |
| JP | 04-182682 | 6/1992 |
| JP | 10-63081 | 3/1998 |
| JP | 2003-057929 A | 2/2003 |
| JP | 2005-156954 | 6/2005 |
| JP | 2007-65400 | 3/2007 |

OTHER PUBLICATIONS

Translation of Tatsumi (JP 2007-65400 A, listed in IDS, pub. date: Mar. 15, 2007).*

Translation of Kimura (JP 2003-057929 A, listed in IDS, pub. date: Feb. 23, 2003).*

Translation of Sakami (JP410031362A, pubn-date: Feb. 3, 1998).*

* cited by examiner

*Primary Examiner* — Walter L Lindsay, Jr.
*Assistant Examiner* — Frederick Wenderoth
(74) *Attorney, Agent, or Firm* — Nixon & Vanderhye P.C.

(57) ABSTRACT

A developing device includes a developer tank for housing a two-component developer containing toner and magnetic carrier; a first conveying portion having a first rotary shaft rotatable about its axis and a first screw blade which surrounds the first rotary shaft and rotates together with the first rotary shaft and contains a ferromagnetic substance; a second conveying portion having a second rotary shaft rotatable about its axis and a second screw blade which surrounds the second rotary shaft and rotates together with the second rotary shaft and contains a ferromagnetic substance; a first electromagnet for magnetizing the first screw blade; and a second electromagnet for magnetizing the second screw blade.

11 Claims, 8 Drawing Sheets

DEVELOPING DEVICE, IMAGE FORMING APPARATUS, AND CLEANING METHOD FOR THE DEVELOPING DEVICE

CROSS-REFERENCE TO RELATED APPLICATION

This application claims priority to Japanese Patent Application No. 2009-020999, which was filed on Jan. 30, 2009, the contents of which are incorporated herein by reference in their entirety.

BACKGROUND OF THE INVENTION

1. Field of the Invention

The present invention relates to a developing device for effecting development with use of a two-component developer containing toner and magnetic carrier, an image forming apparatus, and a cleaning method for the developing device.

2. Description of the Related Art

To date an electrophotographic image forming apparatus has generally been applied to image forming apparatuses such as copying machines and printers. Where the workings of the electrophotographic image forming apparatus are concerned, an electrostatic latent image is formed on a surface of a photoreceptor toner image bearing member). Then, with a toner supplied from a developing device, the electrostatic latent image is developed into a toner image, and the resultant toner image is transferred and fixed onto a recording medium such as a paper sheet. In this way, an image is formed on the recording medium.

In order to achieve formation of images in color and high-quality images as well, recent-model image forming apparatuses employ, as a developing agent, a two-component developer which excels in toner charging stability. The two-component developer is composed of toner and carrier. The toner and the carrier are stirred within a developer tank provided in a developing device of such an image forming apparatus thereby to produce friction between them. Under the friction, the toner can be electrically charged properly.

In recent years, there has been an increasing demand for speedup and miniaturization in image forming apparatuses. For enhanced speed, the two-component developer needs to be electrically charged swiftly and thoroughly while being conveyed quickly. It is particularly necessary for the toner supplied to the developer tank to be dispersed in the two-component developer quickly so as to be electrically charged properly.

In Japanese Unexamined Patent Publication JP-A 10-63081 (1998), there is disclosed a circulation-type developing device composed of two developer conveyance passages through which a two-component developer is passed in circulation and two developer conveying members for conveying the two-component developer with stirring in the developer conveyance passages. In the developing device disclosed in JP-A 10-63081, the two-component developer is conveyed efficiently by the developer conveying member designed in a spiral form.

However, even in the developing device having the spiral developer conveying member that offers high developer conveyance capability, due to centrifugal force and heat resulting from high-speed rotation of the developer conveying member, the developer inconveniently adheres in an aggregated state to the inner wall of the developer tank with the consequence that the flow of the developer is impaired.

SUMMARY OF THE INVENTION

The invention has been devised in an effort to solve the aforestated problem, and accordingly its object is to provide a developing device capable of maintaining satisfactory developer conveyance capability while preventing a developer from adhering in an aggregated state to the inner wall of a developer tank, an image forming apparatus, and a cleaning method for the developing device.

The invention provides a developing device comprising;

a developer containing section for storing therein a two-component developer including toner and magnetic carrier;

a developer conveying section comprising a rotary shaft and a screw blade containing a ferromagnetic substance that is so formed as to extend in a spiral fashion around the rotary shaft and to rotate together with the rotary shaft; and a magnetizing section for magnetizing the screw blade.

According to the invention, the screw blade containing the ferromagnetic substance is magnetized by the magnetizing section. The screw blade in a magnetized state causes the magnetic carrier to bind thereon so as to form a magnetic brush at the radial end part thereof. Hence, in the developing device of the invention, as the developer conveying section is rotated, the developer adhering in an aggregated state to the inner wall of the developer containing section is rubbed off and removed from the inner wall of the developer containing section by the magnetic brush. In this way, cleaning of the developer containing section can be achieved. Accordingly, the developing device is able to maintain satisfactory developer conveyance capability by preventing the developer from adhering in an aggregated state to the inner wall of the developer containing section.

Moreover, in the invention, it is preferable that the developing device comprises a switching section that performs switching between a state where a magnetic field produced by the magnetizing section is applied to the screw blade and a state where no magnetic field is applied to the screw blade.

According to the invention, the switching section performs switching between the state where the magnetic field produced by the magnetizing section is applied to the screw blade and the state where no magnetic field is applied thereto. Hence, during the cleaning of the developer containing section, the switching section acts to establish and hold the state where the magnetic field produced by the magnetizing section is applied to the screw blade. On the other hand, during the time the developer containing section is not subjected to cleaning, the switching section acts to establish and hold the state where no magnetic field is applied to the screw blade. Accordingly, in the developing device of the invention, as compared with the case where the mode of cleaning the developer containing section is in working order, in the case where the mode of cleaning the developer containing section remains at rest, the strength of the force of magnetic carrier constraint exerted by the screw blade is decreased. This makes it possible to achieve stirring and conveyance of the two-component developer with efficiency.

Moreover, in the invention, it is preferable that the magnetizing section is constructed of an electromagnet disposed only in a region near one end of the rotary shaft, and the switching section is constructed of a power source for applying electric current to the electromagnet.

According to the invention, the magnetizing section is disposed only in the region near one end of the rotary shaft. In this case, as compared with the case where the magnetizing section is disposed in a region other than the region near one end of the rotary shaft, the screw blade can be magnetized more readily. This makes it possible to reduce the number of the magnetizing sections, as well as to reduce the size of the magnetizing section, and thereby render the developing device more compact. Note that the magnetic field produced by the electromagnet can be eliminated simply by stopping application of electric current from the power source. Therefore, in contrast to the case where a permanent magnet is used for the magnetizing section, it is possible to perform switching between the state where the magnetic field produced by the magnetizing section is applied to the screw blade and the state where no magnetic field is applied thereto with a simple mechanism, with consequent miniaturization of the developing device. Moreover, in the developing device of the invention, since the screw blade is magnetized by the magnetizing section disposed only in the region near one end of the first rotary shaft, it follows that the magnetic flux density at the radial end part of the screw blade can be made higher than that in the vicinity of the rotary shaft. This makes it possible to render the resultant magnetic brush pieces uniform, thereby enhancing the effect of cleaning the developer containing section.

Moreover, in the invention, it is preferable that the ferromagnetic substance exhibits small remanent magnetization.

Moreover, in the invention, it is preferable that the remanent magnetization of the ferromagnetic substance falls within a range of 0 $Wb/m^2$ or more and 0.5 $Wb/m^2$ or less.

According to the invention, since the ferromagnetic substance contained in the screw blade exhibits small remanent magnetization, and preferably, its remanent magnetization falls within a range of 0 $Wb/m^2$ or more and 0.5 $Wb/m^2$ or less, when the switching section establishes the state where the magnetic field produced by the magnetizing section is no longer applied to the screw blade, then the screw blade loses the force of magnetic carrier constraint. Accordingly, in the developing device of the invention, by changing the developing device to the state where no magnetic field is applied to the screw blade, it is possible to free the magnetic carrier from the constraint of the screw blade swiftly, and thereby rotate the developer conveying section without constraining the magnetic carrier. In this way, at the time of rotating the developer conveying section with the mode of cleaning the developer containing section kept at rest, the stress occurring in the developer can be reduced, thereby preventing the developer from having a short service life.

Moreover, in the invention, it is preferable that the rotary shaft is made of a metal material which exhibits small remanent magnetization.

Moreover, in the invention, it is preferable that the metal material which exhibits small remanent magnetization is a nickel-iron alloy.

According to the invention, the rotary shaft is made of a metal material and thus exhibits high rigidity. Therefore, in the developing device of the invention, the rotary shaft is resistant to deformation and can thus be used for a longer period of time. Further, since the rotary shaft is made of a metal material which exhibits small remanent magnetization, it follows that the screw blade can be magnetized evenly as a whole. Therefore, even in a part of the screw blade which is located relatively away from the magnetizing section, the magnetic brush can be formed with stability. By virtue of the stable formation of the magnetic brush, in the developing device of the invention, the developer containing section can be cleaned out more thoroughly.

In addition, since the rotary shaft exhibits the small remanent magnetization, and preferably, is made of a nickel-iron alloy, when the developing device is changed to the state where no magnetic field is applied to the rotary shaft, then the screw blade is swiftly brought into a non-magnetized state, thus freeing the magnetic carrier from the constraint of the screw blade immediately. Accordingly, during the time the mode of cleaning the developer containing section remains at rest, in the developing device of the invention, the developer conveying section can be rotated without constraining the magnetic carrier. This makes it possible to reduce the stress occurring in the developer at the time of rotating the developer conveying section, and thereby prevent the developer from having a short service life.

Moreover, in the invention, it is preferable that the screw blade and the rotary shaft are formed integrally with each other by using a metal material which exhibits small remanent magnetization.

Moreover, in the invention, it is preferable that the metal material which exhibits small remanent magnetization is a nickel-iron alloy.

According to the invention, since the screw blade and the rotary shaft are formed integrally with each other by using a metal material, it follows that the developer conveying section exhibits high rigidity and can be made more compact. Accordingly, the developing device of the invention can be used for a longer period of time, and also, by making the developer containing section more compact, it is possible to reduce the size of the device as a whole. Moreover, in the developing device of the invention, since the screw blade is made of a metal material which exhibits small remanent magnetization, at the time of rotating the developer conveying section with the mode of cleaning the developer containing section kept at rest, the stress occurring in the developer can be reduced, wherefore the developer can be prevented from having a short service life. Further, in the developing device of the invention, since the rotary shaft is made of a metal material which exhibits small remanent magnetization, and preferably, a nickel-iron alloy, it follows that the screw blade can be magnetized evenly as a whole. Therefore, even in a part of the screw blade which is located relatively away from the magnetizing section, the magnetic brush can be formed with stability, wherefore the developer containing section can be cleaned out more thoroughly.

Moreover, in the invention, it is preferable that the screw blade is made of a resin containing ferrite particles as the ferromagnetic substance.

According to the invention, the screw blade is made of a resin. Hence, the developing device of the invention can include the screw blade having a complicated shape, wherefore the developer containing section can be cleaned out more thoroughly.

The invention further provides an image forming apparatus having the developing device thus far described.

According to the invention, the developing device is able to maintain satisfactory developer conveyance capability while preventing the developer from adhering in an aggregated state to the inner wall of the developer containing section. Accordingly, the image forming apparatus of the invention succeeds in producing images free from unevenness in image density with stability and at high speed.

The invention further provides a cleaning method for a developing device comprising:

magnetizing a developer conveying section having a screw blade containing a ferromagnetic substance; and stirring a two-component developer including toner and magnetic carrier stored in a developer containing section by the developer conveying section in a magnetized state.

According to the invention, the inner wall of the developer containing section can be cleaned out simply by magnetizing the developer conveying section and causing the developer conveying section in a magnetized state to stir the two-component developer. This makes it possible to remove the developer adhering in an aggregated state to the inner wall of the developer containing section at any time, and thereby maintain satisfactory developer conveyance capability. As a result, lack of uniformity in image density can be prevented successfully.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
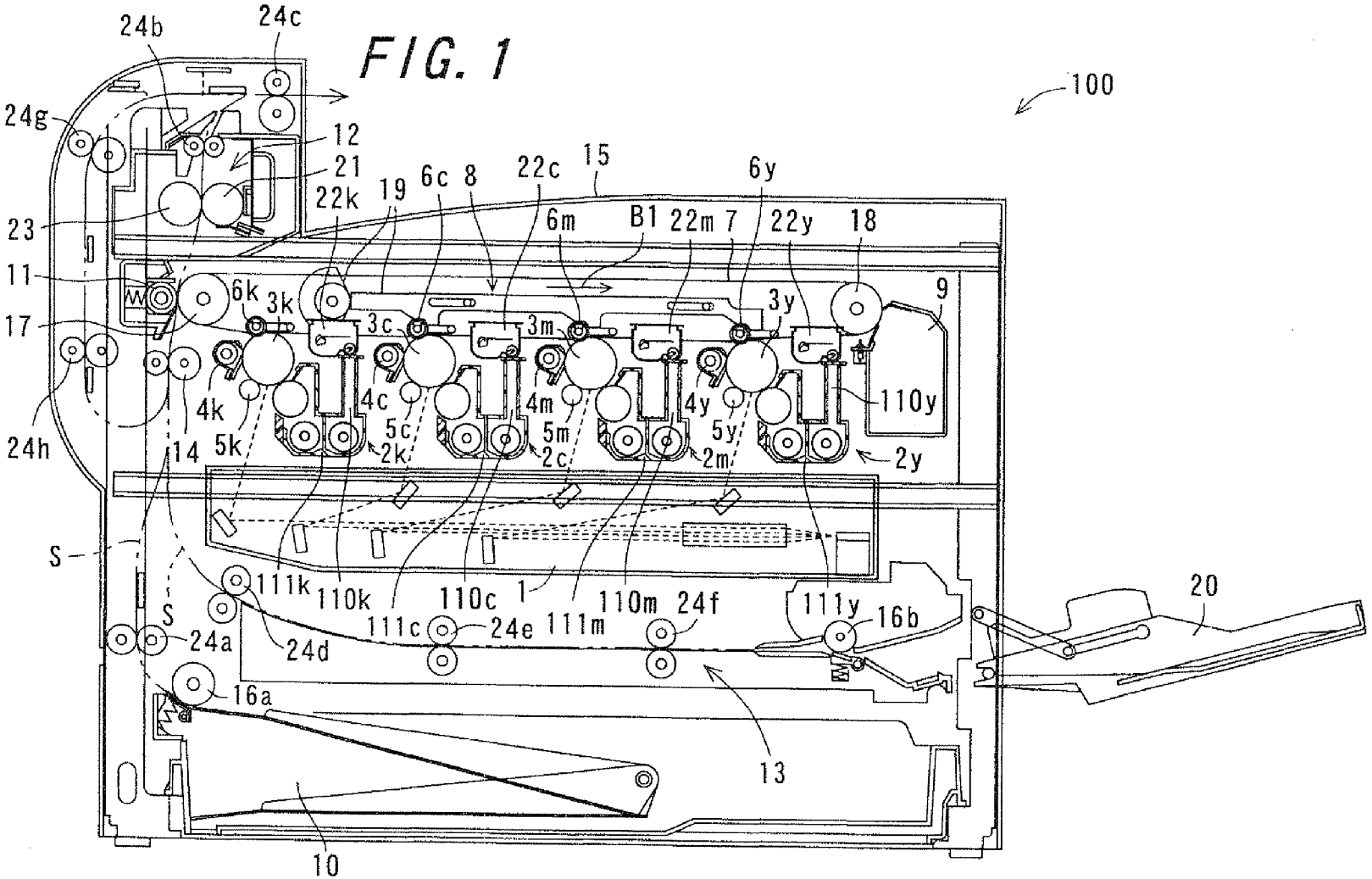
FIG. 1 is a diagram schematically showing a cross section of an image forming apparatus.

Now referring to the drawings, preferred embodiments of the invention will be described in detail.

The image forming apparatus pursuant to the invention is equipped with the developing device pursuant to the invention that will hereafter be described in detail. FIG. 1 is a diagram schematically showing a cross section of an image forming apparatus 100 according to an embodiment of the image forming apparatus of the invention. The image forming apparatus 100 is built as a multi-function peripheral having a copier function, a printer function, and a facsimile function, for forming a full-color or monochrome image on a recording medium on the basis of image information transmitted thereto. That is, the image forming apparatus 100 is provided with three printing modes: a copier mode (duplicator mode), a printer mode, and a facsimile mode. In this construction, for example, in response to a manipulated input through a operating section or scanner section (not shown), as well as the receipt of a print job from a personal computer, a portable terminal unit, an information recording-storage medium, and external equipment using a memory device, a printing mode selection is made by a control unit (not shown).

The image forming apparatus 100 comprises an exposure unit 1; developing devices 2*k*, 2*c*, 2*m*, and 2*y* according to the embodiment of the developing device of the invention; photoreceptor drums 3*k*, 3*c*, 3*m*, and 3*y*; cleaning units 4*k*, 4*c*, 4*m*, and 4*y*; charging sections 5*k*, 5*c*, 5*m*, and 5*y*; an intermediate transfer belt unit 8 including intermediate transfer rollers 6*k*, 6*c*, 6*m*, and 6*y*; a fixing unit 12; a recording medium conveying section 13; toner replenishing sections 22*k*, 22*c*, 22*m*, and 22*y*; and a control unit (not shown). In order to deal with image data on different colors: black (k); cyan (c); magenta (m); and yellow (y) included in color image information on an individual basis, the developing device (2*k*, 2*c*, 2*m*, 2*y*), the photoreceptor drum (3*k*, 3*c*, 3*m*, 3*y*), the cleaning unit (4*k*, 4*c*, 4*m*, 4*y*), the charging section (5*k*, 5*c*, 5*m*, 5*y*), the intermediate transfer roller (6*k*, 6*c*, 6*m*, 6*y*), and the toner replenishing section (22*k*, 22*c*, 22*m*, 22*y*), as well as the members included in the developing device (2*k*, 2*c*, 2*m*, 2*y*) and the toner replenishing section (22*k*, 22*c*, 22*m*, 22*y*), are each correspondingly four in number. As described just above, for the sake of distinction, the constituent members provided separately for each individual color are each represented by a reference numeral added with a color-indicating alphabet (k, c, m, y), but collectively they are represented only by their respective reference numerals.

The photoreceptor drum 3 is so supported as to be driven to rotate about its axis by a driving portion (not shown), and includes a conductive substrate and a photosensitive layer formed on the surface of the conductive substrate, which are not shown. The conductive substrate may be designed in various forms, for example, a cylindrical form, a circular columnar form, and a thin sheet form. Among them, a cylindrical form is desirable. The conductive substrate is constructed of an electrically conductive material. As the electrically conductive material, any of those used customarily in the relevant field can be used. The examples thereof include: a metal such as aluminum, copper, brass, zinc, nickel, stainless steel, chrome, molybdenum, vanadium, indium, titanium, gold, and platinum; an alloy of two or more of these metals; an electrically conductive film obtained by forming, on a film-shaped base such as a synthetic resin film, a metal film, paper, or the like, an electrically conductive layer made of one or two or more of substances selected from among aluminum, an aluminum alloy, tin oxide, gold, indium oxide, and so forth; and a resin composition product containing at least one of electrically conductive particles and electrically conductive polymer. Note that, as the film-shaped base used for the electrically conductive film, a synthetic resin film is desirable, and a polyester film is particularly desirable. Moreover, the electrically conductive layer of the electrically conductive film should preferably be formed by means of vapor deposition, coating, or otherwise.

For example, the photosensitive layer is formed by stacking a charge generating layer containing a charge generating substance and a charge transporting layer containing a charge transporting substance on top of each other. At this time, it is preferable to interpose an undercoat layer between the conductive substrate and the charge generating layer or the charge transporting layer. With the provision of the undercoat layer, it is possible to gain several advantages that flaws and asperities existing on the surface of the conductive substrate can be covered with consequent smoothing of the surface of the photosensitive layer, that deterioration in the chargeability of the photosensitive layer resulting from repeated use can be prevented, and that the charging characteristic of the photosensitive layer under at least one of a low-temperature environment and a low-humidity environment can be enhanced. Alternatively it is also possible to employ a highly-durable laminate photoreceptor of a three-layer structure having a photoreceptor surface protective layer as its uppermost layer.

The charge generating layer is composed predominantly of a charge generating substance which produces electric charge by light irradiation, and may contain heretofore known binder resin, plasticizer, sensitizer, or the like as necessary. As the charge generating substance, any of those used customarily in the relevant field can be used. The examples thereof include: a perylene-based pigment such as perylene imide and perylenic acid anhydride; a polycyclic quinone-based pigment such as quinacridone and anthraquinone; a phthalocyanine-based pigment such as metallophthalocyanine, metal-free phthalocyanine, and halogenated metal-free phthalocyanine; a squarylium dye; an azulenium dye; a thiapyrylium dye; and an azo pigment having a carbazole skeleton, a styryl stilbene skeleton, a triphenyl amine skeleton, a dibenzothiophene skeleton, an oxadiazole skeleton, a fluorenone skeleton, a bisstilbene skeleton, a distyryl oxadiazole skeleton, or a distyryl carbazole skeleton. Among them, a metal-free phthalocyanine pigment, an oxotitanyl phthalocyanine pigment, a bis azo pigment containing at last one of fluorene ring and fluorenone ring, a bis azo pigment composed of aromatic amine, and a tris azo pigment offer high charge production capability and thus lend themselves to formation of a photosensitive layer having high sensitivity. The charge generating substances may be used each alone, or two or more of them may be used in combination. While the content of the charge generating substance is not particularly restricted, it should preferably fail in a range of from 5 to 500 parts by weight, and more preferably from 10 to 200 parts by weight, based on 100 parts by weight of a binder resin contained in the charge generating layer.

As the binder resin for use in the charge generating layer, any of those used customarily in the relevant field can be used. The examples thereof include a melamine resin, an epoxy resin, a silicone resin, polyurethane, an acrylic resin, a vinyl chloride-vinyl acetate copolymer resin, polycarbonate, a phenoxy resin, polyvinyl butyral, polyallylate, polyamide, and polyester. the binder resins may be used each alone, or two or more of them may be used in combination as necessary.

The charge generating layer can be formed as follows. The charge generating substance and the binder resin, and also, if necessary, a plasticizer, a sensitizer, or the like agent, are each dissolved or dispersed in an adequate amount in a suitable organic solvent capable of dissolving or dispersing such components thereby to prepare a coating liquid of the charge generating layer. The charge generating layer coating liquid is applied onto the surface of the conductive substrate, followed by drying, whereupon the charge generating layer is obtained. While the film thickness of the thereby obtained charge generating layer is not particularly restricted, it should preferably fall in a range of from 0.05 to 5 μm, and more preferably from 0.1 to 2.5 μm.

The charge transporting layer laminated on the charge generating layer contains, as essential constituents, a charge transporting substance having the capability of receiving and transporting electric charge produced by the charge generating substance and a binder resin for use in the charge transporting layer, and may also contain heretofore known antioxidant, plasticizer, sensitizer, lubricant, or the like agent as necessary. As the charge transporting substance, any of those used customarily in the relevant field can be used. The examples thereof include: an electron donative substance such as poly-N-vinyl carbazole and its derivatives, poly-γ-carbazolyl ethyl glutamate and its derivatives, a condensation product of pyrene-formaldehyde and its derivatives, polyvinylpyrene, polyvinyl phenanthrene, an oxazole derivative, an oxodiazole derivative, an imidazole derivative, 9-(p-diethyl aminostyryl) anthracene, 1,1-bis(4-dibenzylaminophenyl) propane, styryl anthracene, styryl pyrazoline, a pyrazoline derivative, phenylhydrazones, a hydrazone derivative, a triphenylamine-based compound, a tetraphenyldiamine-based compound, a triphenylmethane-based compound, a stilbene-based compound, and an azine compound having a 3-methyl-2-benzothiazoline ring; and an electron acceptive substance such as a fluorenone derivative, a dibenzothiophene derivative, an indenothiophene derivative, a phenanthrenequinone derivative, an indenopyridine derivative, a thioxanthone derivative, a benzo[c] cinnoline derivative, a phenazine oxide derivative, tetracyanoethylene, tetracyanoquinodimethane, bromanil, chloranil, and benzoquinone. The charge transporting substances may be used each alone, or two or more of them may be used in combination. While the content of the charge transporting substance is not particularly restricted, it should preferably fall in a range of from 10 to 300 parts by weight, and more preferably, from 30 to 150 parts by weight, based on 100 parts by weight of the binder resin contained in the charge transporting layer.

As the binder resin used for the charge transporting layer, any of those used customarily in the relevant field and allowing uniform dispersion of the charge transporting substance can be used. The examples thereof include polycarbonate, polyallylate, polyvinyl butyral, polyamide, polyester, polyketone, an epoxy resin, polyurethane, polyvinylketone, polystyrene, polyacrylamide, a phenol resin, a phenoxy resin, a polysulfone resin, and copolymer resins thereof. Among them, in view of film formation suitability and the abrasion resistance and electrical characteristics of the resultant charge transporting layer, for example, polycarbonate containing bisphenol as a monomer component (hereafter referred to as "bisphenol Z type polycarbonate") and an admixture of bisphenol Z type polycarbonate and polycarbonate of another type are desirable for use. The binder resins may be used each alone, or two or more of them may be used in combination.

It is preferable that the charge transporting layer contains an antioxidant together with the charge transporting substance and the binder resin for use in the charge transporting layer. As the antioxidant, any of those used customarily in the relevant field can be used. The examples thereof include Vitamin E, hydroquinone, hindered amine, hindered phenol, paraphenylene diamine, arylalkane and derivatives thereof, an organic sulfur compound, and an organic phosphorus compound. The antioxidants may be used each alone, or two or more of them may be used in combination. While the content of the antioxidant is not particularly restricted, it should preferably fall in a range of from 0.01 to 10% by weight, and more preferably, from 0.05 to 5% by weight, based on the total amount of the ingredients constituting the charge transporting layer.

The charge transporting layer can be formed as follows. The charge transporting substance and the binder resin, and also, if necessary, an antioxidant, a plasticizer, a sensitizer, or the like agent, are each dissolved or dispersed in an adequate amount in a suitable organic solvent capable of dissolving or dispersing such components thereby to prepare a coating liquid of the charge transporting layer. The charge transporting layer coating liquid is applied onto the surface of the charge generating layer, followed by drying, whereupon the charge transporting layer is obtained. While the film thickness of the thereby obtained charge transporting layer is not particularly restricted, it should preferably fall in a range of from 10 to 50 μm, and more preferably, from 15 to 40 μm.

Alternatively, it is also possible to form a photosensitive layer composed of a single layer containing both a charge generating substance and a charge transporting substance. In this case, various conditions including the kind and content of the charge generating substance and the charge transporting substance, the kind of the binder resin, and with or without the use of other additives may be identical with those adopted in the case of forming the charge generating layer and the charge transporting layer separately.

While this embodiment employs the photoreceptor drum having an organic photosensitive layer composed of the charge generating substance and the charge transporting substance thus far described, it is possible to employ instead a photoreceptor drum having an inorganic photosensitive layer composed for example of silicon.

The charging section 5 is disposed so as to face the photoreceptor drum 3 and to be opposite to the surface of the photoreceptor drum 3 along a longitudinal direction of the photoreceptor drum 3. By the charging section 5, the surface of the photoreceptor drum 3 is electrically charged to a predetermined potential with predetermined polarity. As the charging section 5, a charging device of charging brush-type, a charging device of charger type, a charging device of pin-array charger type, an ion producing device, or the like can be used. While the present embodiment employs a charging device of contact roller type which is brought into pressure-contact with the photoreceptor drum 3, the charging section 5 is not limited thereto but may be of a charging brush, a charging device of contact charging type such as a magnetic brush, or a charging device of non-contact charger type.

The exposure unit 1 is built as a laser scanning unit (LSU) having a laser emitting section and a reflection mirror. The exposure unit 1 is disposed in such a manner that a light beam corresponding to data of each individual color emitted therefrom can pass through a region between the charging section 5 and the developing device 2 so that the surface of the photoreceptor drum 3 irradiated with the laser beam. In the exposure unit 1, image information is converted into light beams corresponding to data of different colors of k, c, m, and y, so that the surface of the photoreceptor drum 3 in a state of being charged at a uniform potential by the charging section 5 can be exposed to the light beams corresponding to the color data with the consequence that an electrostatic latent image is formed thereon. The exposure unit 1 may be practically realized by using, instead of the laser scanning unit, an EL (Electroluminescence) or LED (Light Emitting Diode) writing head constructed by arranging light-emitting elements in an array.

The developing device 2 is disposed so as to face the photoreceptor drum 3, and develops the electrostatic latent image formed on the surface of the photoreceptor drum 3 with the supply of toner thereby to form a toner image which is a visible image.

The toner replenishing section 22 is connected via a toner transport passage member 110 to an upper part of the developing device 2 in the vertical direction thereof, and stores therein an unused toner (powdery toner) and replenishes the developing device 2 with the unused toner. The developing device 2 and the toner replenishing section 22 will hereafter be described in detail.

Following the completion of the development process and image transfer process, the cleaning unit 4 removes and collects residual toner remaining on the surface of the photoreceptor drum 3 to clean the surface of the photoreceptor drum 3.

The intermediate transfer belt unit 8 is disposed vertically above the photoreceptor drum 3, and includes the intermediate transfer roller 6, an intermediate transfer belt 7, a transfer belt cleaning unit 9, a transfer roller 11, a driving roller 17, a driven roller 18, and an intermediate transfer belt tension mechanism 19.

The intermediate transfer belt 7 is an endless belt member made of a film having a thickness ranging from approximately 100 μm to 150 μm. The intermediate transfer belt 7 is supported around the driving roller 17, the driven roller 18, and the intermediate transfer belt tension mechanism 19 in a tensioned state, forming a loop-like traveling path. The intermediate transfer belt 7 is driven to turn in a clockwise direction indicated by an arrow B1 in FIG. 1. The intermediate transfer belt 7 is held between the intermediate transfer roller 6 and the photoreceptor drum 3, with consequent formation of a primary transfer nip region which is the location of contact between the intermediate transfer belt 7 and the photoreceptor drum 3, and the toner image borne on the photoreceptor drum 3 is transferred to the intermediate transfer belt 7.

The driving roller 17 is so disposed as to be driven to rotate about its axis by a driving portion (not shown), and by its rotation drive, the intermediate transfer belt 7 is driven to turn in the direction of the arrow B1.

The driven roller 18 is so disposed as to be rotatable drivenly with the rotation of the driving roller 17. The driven roller 18 imparts a force of constant level to the intermediate transfer belt 7 to remove a slack thereof.

The intermediate transfer belt tension mechanism 19 is so disposed as to support the intermediate transfer belt 7. The intermediate transfer belt tension mechanism 19 imparts a force of constant level to the intermediate transfer belt 7 to remove a slack thereof.

The intermediate transfer roller 6 is rotatably supported on a intermediate transfer roller attachment portion (not shown) of the intermediate transfer belt tension mechanism 19 so as to be brought into pressure-contact with the photoreceptor drum 3, with the intermediate transfer belt 7 interposed therebetween. The intermediate transfer roller 6 is connected with a power source (not shown) for applying transfer bias voltage, and has the capability of transferring the toner image borne on the surface of the photoreceptor drum 3 onto the intermediate transfer belt 7. As employed herein, the transfer bias voltage refers to a voltage for charging the intermediate transfer belt 7 to a polarity (+) reverse to the polarity (−) of the toner in a charged state on the photoreceptor drum 3. In the presence of the transfer bias voltage, the toner image formed on the surface of the photoreceptor drum 3 can be transferred onto the intermediate transfer belt 7. In a case of forming a full-color image, the toner images of different colors formed on their respective photoreceptor drums 3 are transferred and overlaid one after another onto the intermediate transfer belt 7 by the intermediate transfer rollers 6, whereupon a full-color toner image is formed.

The intermediate transfer roller 6 is constructed of a metal (e.g. stainless)-made shaft ranging in diameter from 8 mm to 10 mm used as a base, the surface of which is covered with an electrically conductive elastic material (for example, EPDM (Ethylene Propylene Diene M-class) rubber or urethane foam). With the conductive elastic material, the intermediate transfer roller 6 is capable of applying a high voltage uniformly to the intermediate transfer belt 7. While, in the present embodiment, the roller-shaped intermediate transfer roller 6 is used as means for applying transfer bias voltage, a brush-shaped electrode may be used instead.

The transfer roller 11 is brought into pressure-contact with the driving roller 17, with the intermediate transfer belt 7 interposed therebetween, and is so disposed as to be driven to rotate about its axis by a driving portion (not shown). The transfer roller 11 is connected to a power source (not shown) for applying a voltage for transferring the toner image borne on the intermediate transfer belt 7 onto the recording medium. This voltage is a high voltage of a polarity (+) reverse to the polarity (−) of the toner in a charged state. In a secondary transfer nip region which is the location of contact between the transfer roller 11 and the driving roller 17, the toner image borne on the intermediate transfer belt 7 is conveyed in accompaniment with the turning of the intermediate transfer belt 7 so as to be transferred onto the recording medium fed from the recording medium conveying section 13 which will hereafter be described. In order to achieve the constant formation of the secondary transfer nip region, where the transfer roller 11 and the driving roller 17 are concerned, one of them is made of a hard material such as a metal, and the other is made of a soft material such as an elastic roller (elastic rubber roller, resin foam roller, or the like). After passing through the secondary transfer nip region, the recording medium bearing the toner image is delivered to the fixing unit 12.

The transfer belt cleaning unit 9 is disposed face to face with the driven roller 18, with the intermediate transfer belt 7 interposed therebetween, and has a cleaning blade which is brought into contact with the outer peripheral surface of the intermediate transfer belt 7. The transfer belt cleaning unit 9 acts to remove and collect the toner that adhered to the intermediate transfer belt 7 due to the contact between the intermediate transfer belt 7 and the photoreceptor drum 3, as well as the toner left untransferred on the intermediate transfer belt 7 even after the transfer of the toner image from the intermediate transfer belt 7 to the recording medium. If the residual toner is not removed properly, it will be causative of undesirable mixing of toner colors in the subsequent image forming operation, or the residual toner will adhere to the transfer roller 11 with the consequence that the image-free back side of the recording medium gets a stain.

The fixing unit 12 is disposed downstream of the transfer roller 11 in the direction in which the recording medium is conveyed, and includes a heat roller 21, a pressure roller 23, and so forth. In the fixing unit 12, the recording medium bearing the toner image is held between the heat roller 21 and the pressure roller 23, so that the toner image can be fixed onto the recording medium. As the heat roller 21 and the pressure roller 23 are rotated while holding the recording medium, the recording medium is conveyed downstream in the recording medium conveyance direction.

The heat roller 21 is so disposed as to be rotatably driven by a driving portion (not shown). The heat roller 21 heats and fuses toner constituting a yet-to-be-fixed toner image borne on the recording medium. In the interior of the heat roller 21 is disposed a heating portion (not shown). The heating portion applies heat to the heat roller 21 in such a manner that the temperature of the surface of the heat roller 21 can be raised to a predetermined temperature (fixing temperature). As the heating portion, for example, a heater, a halogen lamp, or the like can be used. In the vicinity of the surface of the heat roller 21 is disposed a temperature detector (not shown) for detecting the surface temperature of the heat roller 21. The result of detection produced by the temperature detector is written to a memory portion of a control unit which will hereafter be described. On the basis of the result of detection produced by the temperature detector, the control unit effects control of the heat roller 21 in a manner so as to reach the fixing temperature.

The pressure roller 23 is so disposed as to be brought into pressure-contact with the heat roller 21, and is so supported that it can be rotated drivenly with the rotation of the heat roller 21. The pressure roller 23 fixes the toner image on the recording medium in cooperation with the heat roller 21. At this time, the pressure roller 23 assists in the fixation of the toner image onto the recording medium by pressing the toner in a fused state due to heat from the heat roller 21, against the recording medium. A pressure-contact region between the heat roller 21 and the pressure roller 23 is a fixing nip region. After the toner image is fixed into place at the fixing nip region, the recording medium having the fixed toner image is discharged on a catch tray 15 by the recording medium conveying section 13 which will hereafter be described.

The recording medium conveying section 13 includes a paper feeding tray 10, a manual feeding tray 20, pick-up rollers 16*a* and 16*b*, conveying rollers 24*a*, 24*b*, 24*c*, 24*d*, 24*e*, 24*f*, 24*g*, and 24*h*, registration rollers 14, and the catch tray 15. In the recording medium conveying section 13, the recording medium fed from the paper feeding tray 10 or the manual feeding tray 20 is conveyed through a recording medium conveyance path S to the secondary transfer nip region, and is then conveyed through the recording medium conveyance path S to the fixing nip region. Following the completion of fixation, the recording medium is discharged on the catch tray 15.

The paper feeding tray 10 is a case-like member for stocking the recording medium, which is disposed vertically below the exposure unit 1. The examples of the recording medium for use include plain paper, color copy paper, an overhead projector sheet, and a postcard.

The manual feeding tray 20 is a member for stocking the recording medium, which is disposed on an outside of the image forming apparatus 100.

The pick-up roller 16*a* is disposed at the end part of the paper feeding tray 10, for picking up the recording mediums sheet by sheet from the paper feeding tray 10 and feeding them to the recording medium conveyance path S. The pick-up roller 16*b* is disposed in the vicinity of the manual feeding tray 20, for picking up the recording mediums sheet by sheet from the manual feeding tray 20 and feeding them to the recording medium conveyance path S.

The conveying rollers 24*a* to 24*h* are each a pair of roller members that are so disposed as to come into pressure-contact with each other. A plurality of the conveying rollers are arranged along the recording medium conveyance path S. The conveying rollers 24*a* to 24*h* act to convey the recording medium.

The registration rollers 14 are a pair of roller members that are so disposed as to come into pressure-contact with each other. By the registration rollers 14, the recording medium fed from the conveying roller 24*a*, the conveying roller 24*d*, or the conveying roller 24*h* is conveyed to the secondary transfer nip region.

The catch tray 15 is disposed in an upper part of the image forming apparatus 100 in the vertical direction thereof, for storing the recording medium having an image fixed thereon in a face-down manner.

Now, a description will be given as to the conveyance of the recording medium effected by the recording medium conveying section 13. In the image forming apparatus 100, the recording mediums stored in the paper feeding tray 10 or the manual feeding tray 20 are delivered sheet by sheet to the recording medium conveyance path S by the pick-up roller 16*a* or the pick-up roller 16*b*. In a case of performing single-sided printing operation, the recording medium fed from the paper feeding tray 10 is conveyed to the registration rollers 14 by the conveying rollers 24*a* disposed at a location along the recording medium conveyance path S. The recording medium is further conveyed by the registration rollers 14 to the secondary transfer nip region in a timed relation such that the front end of the recording medium is aligned with the front end of the toner image borne on the intermediate transfer belt 7. In the secondary transfer nip region, the toner image is transferred onto the recording medium. The recording medium having the toner image transferred thereon is conveyed to the fixing unit 12 where the toner image is fixed into place. After that, the recording medium is conveyed vertically upwardly by the conveying rollers 24*b*, and is eventually discharged onto the catch tray 15 by the conveying rollers 24*c*.

Moreover, the recording medium fed from the manual feeding tray 20 is conveyed to the registration rollers 14 through the conveying rollers 24*f*, the conveying rollers 24*e*, and the conveying rollers 24*d* in the order named. From that point on, the recording medium is conveyed in a manner similar to that conveying the recording medium fed from the paper feeding tray 10 so as to be discharged onto the catch tray 15.

On the other hand, in a case of performing double-sided printing operation, after the toner image is fixed onto one side of the recording medium by the fixing unit 12 in the aforestated manner, the rear end of the recording medium is gripped by the conveying rollers 24*c* immediately before the timing of recording medium discharge constituting a final step in the single-sided printing operation. In this state, the conveying rollers 24*c* are rotated in a reverse direction so that the recording medium can be conveyed to the conveying rollers 24*g*. The recording medium is conveyed to the conveying rollers 24*h* by the conveying rollers 24*g*, and is then conveyed to the registration rollers 14 once again by the conveying rollers 24*h*. After passing through the registration rollers 14, the other side, namely the back side of the recording medium is subjected to toner image printing and is whereafter discharged onto the catch tray 15 just as is the case with the single-sided printing operation.

The image forming apparatus 100 includes the control unit (not shown). For example, the control unit is disposed in the upper part of the interior space of the image forming apparatus 100 in the vertical direction thereof, and includes a memory portion, a computing portion, and a control portion. The memory portion of the control unit receives input of, for example, various setting values provided via an operation panel (not shown) disposed on the top surface of the image forming apparatus 100 in the vertical direction thereof, the results of detection produced by sensors (not shown) arranged at predetermined locations within the image forming apparatus 100, and image information provided from external equipment. Moreover, the programs for carrying out various processing steps in the image forming apparatus 100 are written to the memory portion. As the memory portion, any of those used customarily in the relevant field can be used. The examples thereof include a read only memory (ROM), a random access memory (RAM), and a hard disk drive (HDD). As the external equipment, electrical and electronic apparatuses that allow formation or acquisition of image information and are electrically connectable to the image forming apparatus 100 can be used. The examples thereof include a computer, a digital camera, a television set, a video recorder, a DVD (Digital Versatile Disc) recorder, a HD DVD (High Definition Digital Versatile Disc) recorder, a Blu-ray Disc recorder, a facsimile machine, and a portable terminal apparatus. The computing portion retrieves various data written to the memory portion (image formation command, detection result, image information, and so forth) and the programs for the various processing steps to form necessary judgments. In response to the results of judgment produced by the computing portion, the control portion issues control signals to pertinent devices thereby to exercise operational control. The control portion, as well as the computing portion includes a processing circuit practically realized by using a microcomputer, a microprocessor, or the like device having a Central Processing Unit (CPU). The control unit includes, in addition to the processing circuit described just above, a main power supply for supplying electric power not only to the control unit but also to various devices incorporated within the image forming apparatus 100.

Figure 2:
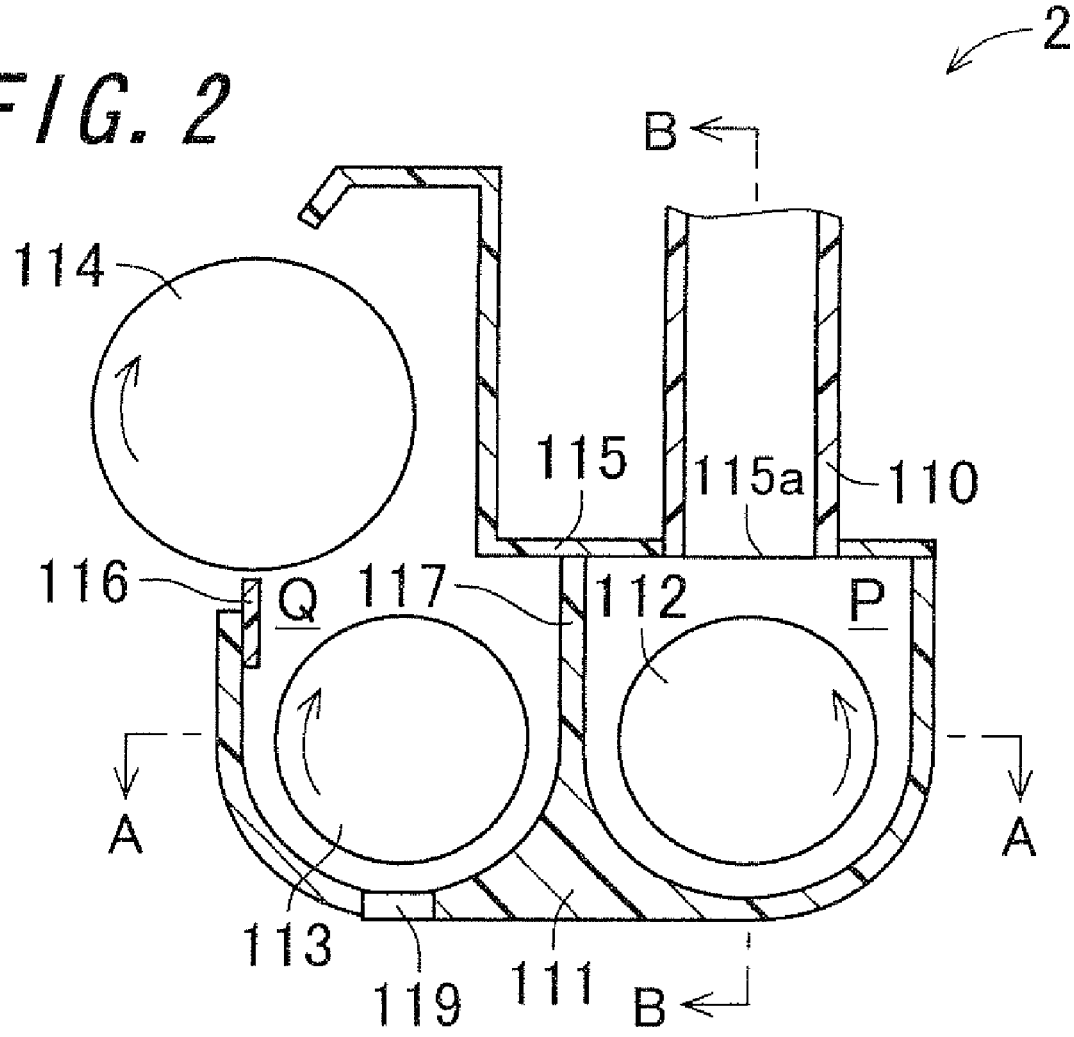
FIG. 2 is a diagram schematically showing a cross section of a developing device.
Figure 3:
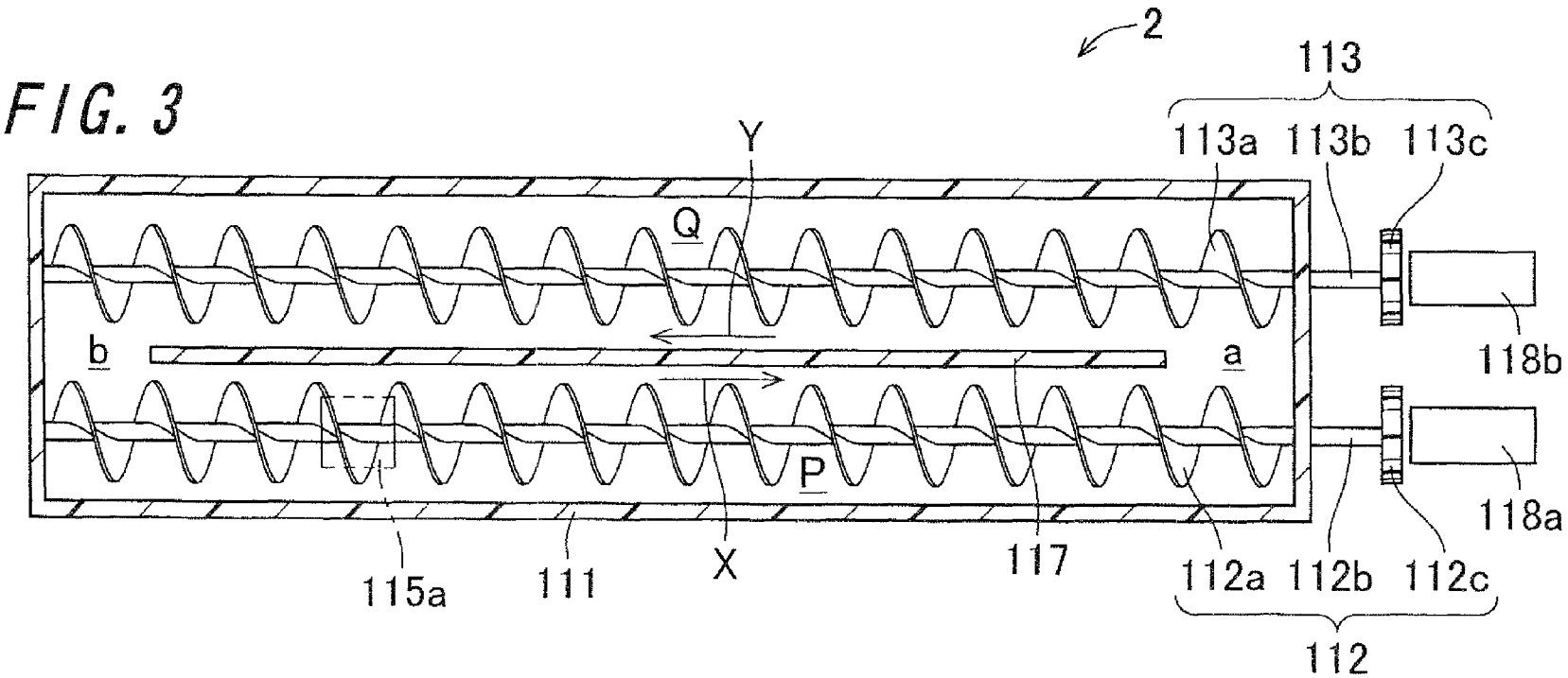
FIG. 3 is a sectional view of the developing device taken along the section line A-A of FIG. 2.
Figure 4:
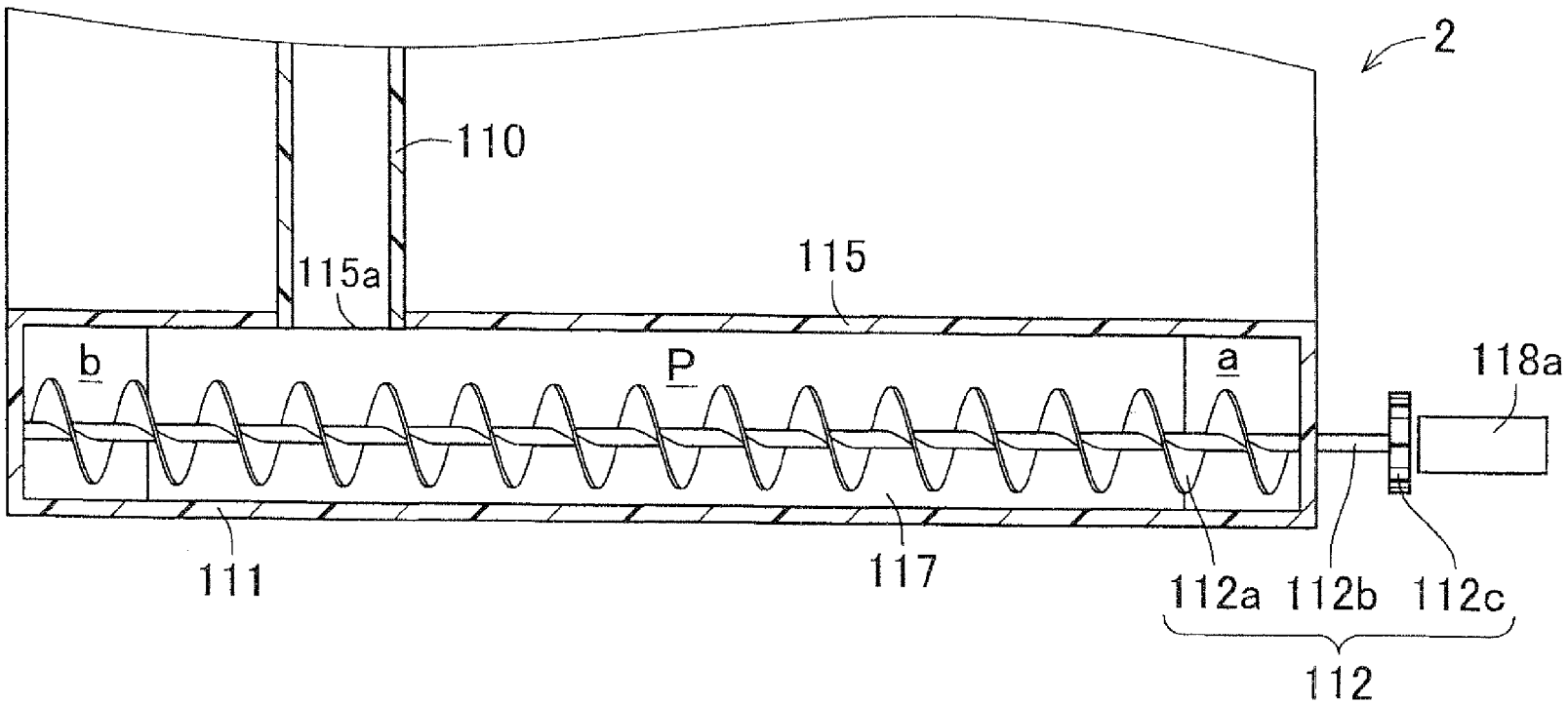
FIG. 4 is a sectional view of the developing device taken along the section line B-B of FIG. 2.

Next, the developing device pursuant to the invention will be described in detail. The developing device of the invention comprises a developer containing section, a developer conveying section, and a magnetizing section. FIG. 2 is a diagram schematically showing a cross section of a developing device 2 according to an embodiment of the developing device of the invention. Moreover, FIG. 3 is a sectional view of the developing device 2 taken along the section line A-A of FIG. 2. The section line A-A is a horizontal line passing through a first conveying portion 112 and a second conveying portion 113. Moreover, FIG. 4 is a sectional view of the developing device 2 taken along the section line B-B of FIG. 2. The section line B-B is a vertical line passing through the first conveying portion 112. Note that, in FIGS. 3 and 4, the first conveying portion 112, the second conveying portion 113, a first electromagnet 118*a*, and a second electromagnet 118*b* are illustrated as a front view. The developing device 2 includes the toner transport passage member 110, a developer tank 111 constituting the developer containing section, the first and second conveying portions 112 and 113 constituting the developer conveying section, a developing roller 114, a developer tank cover 115, a doctor blade 116, a partition plate 117, the first and second electromagnets 118*a* and 118*b* constituting the magnetizing section, and a toner density detecting sensor 119.

The developer tank 111 is a container-like member for housing a two-component developer including toner and magnetic carrier. The developer tank 111 accommodates the developing roller 114, the first conveying portion 112, and the second conveying portion 113 while supporting them so as to be rotatably driven. The developer tank 111 has an opening formed on the surface thereof facing the photoreceptor drum 3. The developing roller 114 is positioned so as to be opposed to the photoreceptor drum 3 through the opening. Although any given heretofore known magnetic carrier can be adopted for use in the present embodiment, magnetic carrier that exhibits small remanent magnetization is desirable. For example, ferrite carrier as typified by Mn—Mg can be used.

The developing roller 114 is a magnet roller which is driven to rotate about its axis by a driving portion (not shown). The magnetic carrier is constrained under the magnetic force exerted by the magnet roller, so that the two-component developer within the developer tank 111 can be conveyed to the photoreceptor drum 3. The developing roller 114 is disposed so as to face the photoreceptor drum 3 and apart from the photoreceptor drum 3 at a distance. The two-component developer conveyed by the developing roller 114 comes into contact with the photoreceptor drum 3 at a location where the developing roller 114 is brought into closest proximity to the photoreceptor drum 3. The region of contact is a development nip region. In the development nip region, since the developing roller 114 receives application of a development bias voltage from a power source (not shown) connected thereto, it follows that the toner constituting the two-component developer present on the surface of the developing roller 114 is supplied to the electrostatic latent image borne on the surface of the photoreceptor drum 3.

The doctor blade 116 is a plate-like member extending in parallel with an axial direction of the developing roller 114. The doctor blade 116 is disposed vertically below the developing roller 114 in such a manner that, when viewed in the direction of its shorter edge (transverse direction), one end thereof is supported by the developer tank 111 and the other end thereof is located away from the surface of the developing roller 114. The doctor blade 116 regulates the amount of the two-component developer conveyed by the developing roller 114 properly. While, in the present embodiment, stainless steel is used as the material of construction of the doctor blade 116, aluminum, synthetic resin, or the like can be used instead.

The toner density detecting sensor 119 is disposed on the bottom surface of the developer tank 111 located vertically below the second conveying portion 113, with its sensor surface exposed on the inner side of the developer tank 111. Any given commonly-used toner density detecting sensor can be used for the toner density detecting sensor 119. While, in the present embodiment, a magnetic permeability detecting sensor is used for the toner density detecting sensor 119, a transmitted light detecting sensor, a reflected light detecting sensor, or the like can be used instead.

The magnetic permeability detecting sensor is electrically connected to a toner density control section (not shown). In response to a toner density measurement value produced as the result of detection by the magnetic permeability detecting sensor, the toner density control section effects control of a toner discharge portion 122 in a manner so as to rotate, so that the unused toner can be supplied to the developer tank 111 interiorly thereof through a toner discharge port 121*a*. To be more specific, when the toner density control section determines that the toner density measurement value produced by the magnetic permeability detecting sensor is lower than a predetermined toner density value, a control signal for driving the toner discharge portion 122 to rotate is issued by the toner density control section with the consequence that the toner discharge portion 122 is rotatably driven.

Moreover, the magnetic permeability detecting sensor is connected with a power source (not shown). The power source applies a driving voltage to drive the magnetic permeability detecting sensor and a control voltage to deliver output of the result of detection to the toner density control section to the magnetic permeability detecting sensor. The application of voltage to the magnetic permeability detecting sensor effected by the power source is controlled by the control unit. The magnetic permeability detecting sensor is a sensor of the type that produces output of the result of detection in the form of an output voltage value under control voltage application. Being basically designed to exhibit great sensitivity at values close to a median output voltage, the sensor receives application of such a control voltage as to obtain an output voltage of the level close to the median value. Magnetic permeability detecting sensors of this type are commercially available. For example, there are known TS-L, TS-A, and TS-K (product names) manufactured by TDK Corporation.

The developer tank cover 115 is disposed to be detachable to the upper part of the developer tank 111 in the vertical direction thereof. The developer tank cover 115 is formed with a toner supply port 115*a* which is a substantially rectangular opening for replenishing the developer tank 111 with the unused toner. The toner supply port 115*a* is connected with the toner transport passage member 110, so that the unused toner from the toner replenishing section 22 can be replenished through the toner transport passage member 110.

The toner transport passage member 110 is a substantially rectangular tubular member extending in the vertical direction thereof. The toner transport passage member 110 is connected to the toner supply port 115*a* at its lower part in the vertical direction, and is connected to the toner discharge port 121*a* at its upper part in the vertical direction thereof. The unused toner stored in the toner replenishing section 22 is supplied through the toner transport passage member 110 to the developing device 2.

The partition plate 117 is disposed between the first conveying portion 112 and the second conveying portion 113. The partition plate 117 is so formed as to extend in parallel with a longitudinal direction of the first conveying portion 112 as well as the second conveying portion 113. The interior part of the developer tank 111 is divided by the partition plate 117 into a first conveyance passage P in which is placed the first conveying portion 112 and a second conveyance passage Q in which is placed the second conveying portion 113. Moreover, at each longitudinal end of the first conveying portion 112 as well as the second conveying portion 113, the partition plate 117 is located away from the inner wall surface of the developer tank 111. That is, the first conveyance passage P and the second conveyance passage Q are formed with a first communication passage a and a second communication passage b located respectively one around each longitudinal end of the first conveying portion 112 as well as the second conveying portion 113, thereby providing communication between the first conveyance passage P and the second conveyance passage Q. In FIG. 3, the communication passage formed on one side indicated by the arrow X is the first communication passage a, whereas the communication passage formed on the other side indicated by the arrow Y is the second communication passage b.

Moreover, the toner supply port 115*a* is formed within the domain of the first conveyance passage P, and more specifically it is located at a position slightly closer to the one side indicated by the arrow X from the neighborhood of the second communication passage b.

The first conveying portion 112 is placed in, of the two separate regions in the developer tank 111 obtained by the provision of the partition plate 117, the one facing toward the toner transport passage member 110. The first conveying portion 112 includes a first screw auger comprising a first rotary shaft 112*b* which is rotated about its axis and a first screw blade 112*a* which extends in a spiral fashion around the first rotary shaft 112*b* and is rotated together with the first rotary shaft 112*b*. The first conveying portion 112 comprises the first screw auger and a first rotary gear 112*c*. The first conveying portion 112 is a member which is rotated about its axis while stirring and conveying the two-component developer.

The first rotary gear 112*c* is connected to longitudinal one end of the first rotary shaft 112*b*. In FIG. 2, the first rotary shaft 112*b* is illustrated as being driven to rotate counterclockwise, through the first rotary gear 112*c*, by a first conveying portion driving portion (not shown). The first rotary gear 112*c* should preferably be made of a metal material which exhibits small remanent magnetization. In the present embodiment, a nickel-iron alloy which exhibits ferromagnetism (permalloy) is adopted for use as the metal material.

The first screw blade 112*a* includes a ferromagnetic substance. It is preferable that the ferromagnetic substance exhibits small remanent magnetization, and more specifically, the remanent magnetization falls within a range of 0 $Wb/m^2$ or more and 0.5 $Wb/m^2$ or less. It is also preferable that the first screw blade 112*a* is made of a resin containing ferrite particles as the ferromagnetic substance. In the present embodiment, the first screw blade 112*a* is made of a styrene resin material containing 20% by weight of ferrite particles having a particle size of 100 μm and remanent magnetization of 0 dispersed uniformly therein. Although it is particularly preferable that the ferromagnetic substance such as ferrite particles is dispersed uniformly in the first screw blade 112*a*, the ferrite particles should preferably be contained in at least the radial end part of the first screw blade 112*a*.

As the ferrite particles, heretofore known one can be used. Moreover, the ferrite particles can be produced as follows. As ferrite raw materials, 50 mol % of iron oxide, 35 mol % of manganese oxide, 14.5 mol % of magnesium oxide, and 0.5 mol % of strontium oxide (manufactured by KDK Co., Ltd) in aqueous dispersion form are pulverized together for 4 hours in a ball mill to obtain a slurry. The slurry is dried by a spray drier to obtain perfectly spherical particles. The perfectly spherical particles are calcined at 930° C. for 2 hours by a rotary kiln. The resultant calcined powder is pulverized into fine particles having a volumetric average particle size of 2 μm or below by a wet grinding mill (using steel balls as a pulverization medium). Then, with the addition of 2% by weight of polyvinyl alcohol (PVA), the slurry is granulated and dried by a spray drier, and is whereafter fired for 4 hours in an electric furnace under conditions of a temperature of 1100° C. and oxygen concentration of 0% by volume. After that, the resultant product is subjected to pulverizing process and classification process. In this way, ferrite particles having a volumetric average particle size of 100 μm can be obtained.

While it is possible to design the first screw blade 112*a* in any given form heretofore known in the field of screw auger development, the first screw blade 112*a* should preferably be so shaped that its radial end part has a pointed front end, the front end face of which ranges in width from 0.5 mm to 1 mm.

In FIG. 2, the first rotary shaft 112*b* is illustrated as being driven to rotate counterclockwise. The first conveying portion 112 is designed to convey the two-component developer in the direction of the arrow X under the rotation of the first screw auger comprising the first screw blade 112*a* and the first rotary shaft 112*b*. The first rotary shaft 112*b* should preferably be made of a metal material which exhibits small remanent magnetization. In the present embodiment, just as is the case with the first rotary gear 112*c*, permalloy is adopted for use as the metal material.

Moreover, by way of another embodiment, the first screw blade 112*a* and the first rotary shaft 112*b* are formed integrally with each other by using a metal material which exhibits small remanent magnetization. As the metal material, just as is the case with the first rotary shaft 112*b* and the first rotary gear 112*c*, permalloy is adopted for use.

The first electromagnet 118*a* is disposed only in the region near one end of the first rotary shaft 112*b* and the first rotary gear 112*c* connected to the one end, and magnetizes the first screw blade 112*a*. It is preferable that the first electromagnet 118*a* is provided to be away from the first rotary gear 112*c* at a distance of 1 mm or more and 5 mm or less, and that the magnetic moment of the first electromagnet 118*a* falls within a range of 1 Wb·m or more and 2.5 Wb·m or less. In the present embodiment, the first electromagnet 118*a* is provided so as to be away from the first rotary gear 112*c* at a distance of 2 mm, and the magnetic moment thereof is set at 1.2 Wb·m.

The first electromagnet 118*a* is connected with a first electromagnet power source (not shown). When the first electromagnet power source applies electric current to the first electromagnet 118*a*, a magnetic field is produced, thereby magnetizing the first conveying portion 112. Moreover, the first electromagnet power source serves also as a switching section that performs switching between a state where the electric current is applied to the first electromagnet 118*a* and a state where no electric current is applied thereto to perform switching between a state where the magnetic field produced by the first electromagnet 118*a* is applied to the first screw blade 112*a* and a state where no magnetic field is applied thereto. In the present embodiment, during the image forming operation and preparatory actions for image formation as well, the first electromagnet 118*a* is not subjected to application of electric current by the first electromagnet power source to avoid magnetization of the first conveying portion 112. On the other hand, during a cleaning mode which will hereafter be described, the first electromagnet 118*a* is subjected to application of electric current by the first electromagnet power source to effect magnetization of the first conveying portion 112.

The second conveying portion 113 is disposed in parallel with the first conveying portion 112, with the partition plate 117 interposed therebetween. The first and second conveying portions 112 and 113 have the same level in the vertical direction thereof. The second conveying portion 113 includes a second screw auger comprising a second rotary shaft 113*b* which is rotated about its axis and a second screw blade 113*a* which extends in a spiral fashion around the second rotary shaft 113*b* and is rotated together with the second rotary shaft 113*b*. The second conveying portion 113 comprises the second screw auger and a second rotary gear 113*c*. The second conveying portion 113 is a member which is rotated about its axis while stirring and conveying the two-component developer.

The second rotary gear 113*c* is connected to longitudinal one end of the second rotary shaft 113*b*. In FIG. 2, the second rotary shaft 113*b* is illustrated as being driven to rotate clockwise, through the second rotary gear 113*c*, by a second conveying portion driving portion (not shown). The second rotary gear 113*c* should preferably be made of a metal material which exhibits small remanent magnetization. In the present embodiment, just as is the case with the first rotary gear 112*c*, permalloy is adopted for use as the metal material.

The second screw blade 113*a* includes a ferromagnetic substance. It is preferable that the ferromagnetic substance exhibits small remanent magnetization, and more specifically the remanent magnetization falls within a range of 0 $Wb/m^2$ or more and 0.5 $Wb/m^2$ or less. It is also preferable that the second screw blade 113*a* is made of a resin containing ferrite particles as the ferromagnetic substance. In the present embodiment, the second screw blade 113*a* is made of a styrene resin material containing 20% by weight of ferrite particles having a particle size of 100 μm and remanent magnetization of 0 dispersed uniformly therein. As the ferrite particles, the same as that used for the first screw blade 112*a* can be used. Moreover, it is preferable that the second screw blade 113*a* is identical in shape with the first screw blade 112*a*.

In FIG. 2, the second rotary shaft 113*b* is illustrated as being driven to rotate clockwise. The second conveying portion 113 is designed to convey the two-component developer in the direction of the arrow Y under the rotation of the second screw auger comprising the second screw blade 113*a* and the second rotary shaft 113*b*. The second rotary shaft 113*b* should preferably be made of a metal material which exhibits small remanent magnetization. In the present embodiment, just as is the case with the second rotary gear 113*c*, permalloy is adopted for use as the metal material.

Moreover, by way of another embodiment, the second screw blade 113*a* and the second rotary shaft 113*b* are formed integrally with each other by using a metal material which exhibits small remanent magnetization. As the metal material, just as is the case with the second rotary shaft 113*b* and the second rotary gear 113*c*, permalloy is adopted for use.

The second electromagnet 118*b* is disposed only in the region near one end of the second rotary shaft 113*b* and the second rotary gear 113*c* connected to the one end, and magnetizes the second screw blade 113*a*. It is preferable that the second electromagnet 118*b* is provided so as to be away from the second rotary gear 113*c* at a distance of 1 mm or more and 5 mm or less, and that the magnetic moment of the second electromagnet 118*b* falls within a range of 1 Wb·m or more and 2.5 Wb·m or less. In the present embodiment, the second electromagnet 118*b* is provided so as to be away from the second rotary gear 113*c* at a distance of 2 mm, and the magnetic moment thereof is set at 1.2 Wb·m.

The second electromagnet 118*b* is connected with a second electromagnet power source (not shown). When the second electromagnet power source applies electric current to the second electromagnet 118*b*, a magnetic field is produced, thereby magnetizing the second conveying portion 113. Moreover, the second electromagnet power source serves also as a switching section that performs switching between a state where the electric current is applied to the second electromagnet 118*b* and a state where the electric current is not applied thereto to perform switching between a state where the magnetic field produced by the second electromagnet 118*b* is applied to the second screw blade 113*a* and a state where no magnetic field is applied thereto. In the present embodiment, during the image forming operation and the preparatory actions for image formation as well, the second electromagnet 118*b* is not subjected to application of electric current by the second electromagnet power source to avoid magnetization of the second conveying portion 113. On the other hand, during the subsequently-described cleaning mode, the second electromagnet 118*b* is subjected to application of electric current by the second electromagnet power source to effect magnetization of the second conveying portion 113.

Figure 5:
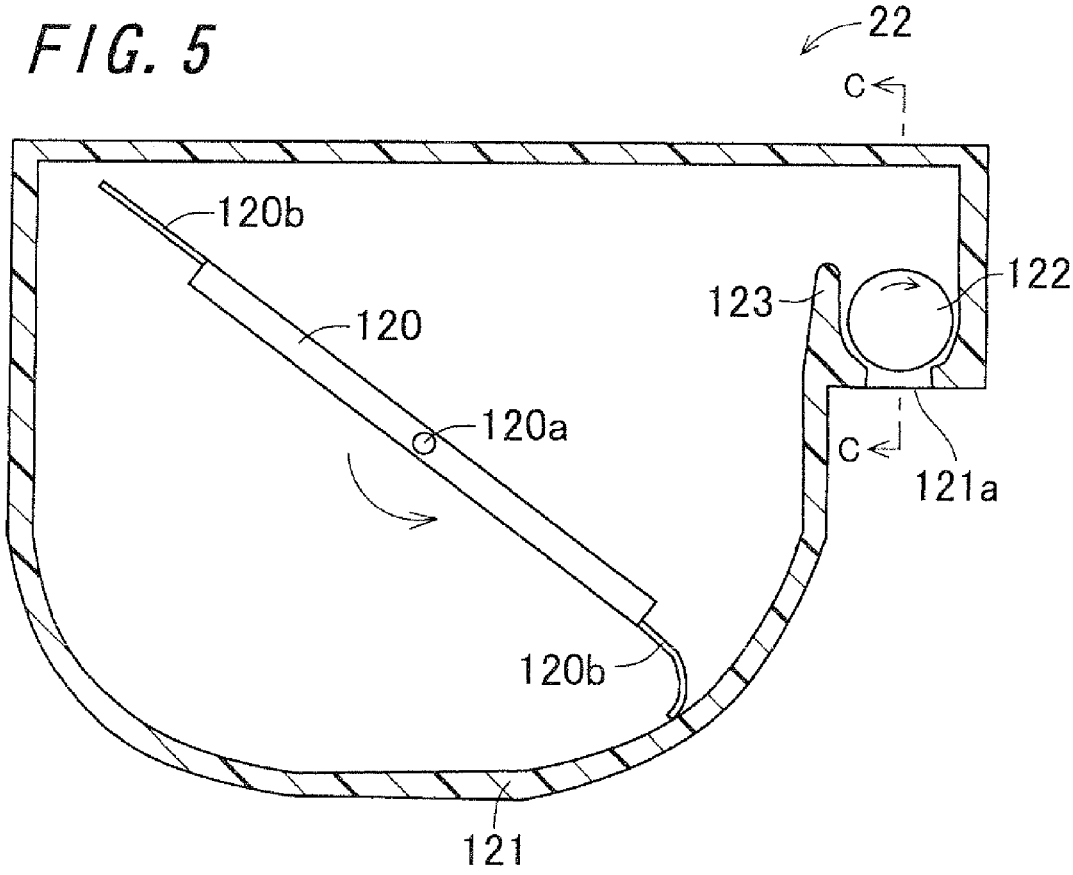
FIG. 5 is a diagram schematically showing the cross section of the toner replenishing section.
Figure 6:
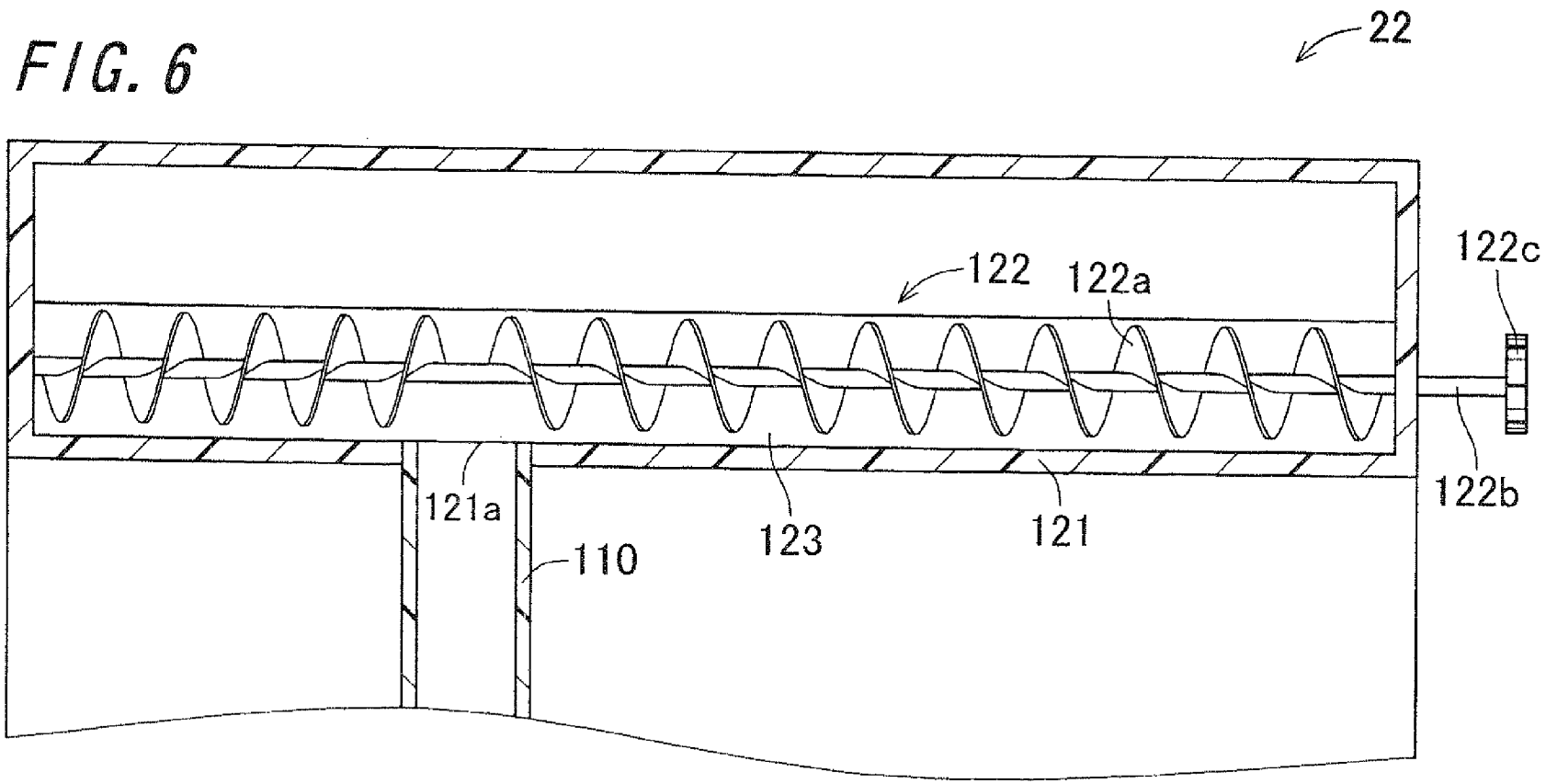
FIG. 6 is a sectional view of the toner replenishing section taken along the section line C-C of FIG. 5.

Next, the toner replenishing section 22 will be described in detail. FIG. 5 is a diagram schematically showing the cross section of the toner replenishing section 22. The toner replenishing section 22 includes a toner stirring portion 120, a toner container 121, the toner discharge portion 122, and a toner discharge portion partition wall 123. Moreover, FIG. 6 is a sectional view of the toner replenishing section 22 taken along the section line C-C of FIG. 5. The section line C-C is a vertical line passing through the toner discharge portion 122. Note that, in FIG. 6, the toner discharge portion 122 is illustrated as a front view.

The toner container 121 is a semi-cylindrical container member having internal space, for storing therein the unused toner while rotatably supporting the toner stirring portion 120 and the toner discharge portion 122. In the toner container 121, the toner discharge port 121*a* is formed. The toner discharge port 121*a* is a substantially rectangular opening formed vertically below the toner discharge portion 122 and located on the left side of the center of the toner discharge portion 122, as viewed in FIG. 6. The toner discharge port 121*a* is connected with the toner transport passage member 110.

The toner stirring portion 120 is a plate-like member and includes a toner scooper 120*b* disposed at its front end and a rotary shaft 120*a*. The toner stirring portion 120 is rotated about the rotary shaft 120*a* in a counterclockwise direction in FIG. 5. Under this action, the unused toner stored in the toner container 121 is stirred and scooped up so as to be supplied to the toner discharge portion 122. The toner scooper 120*b* is made of a flexible polyethylene terephthalate (PET) sheet, and is attached to each end of the toner stirring portion 120. By virtue of its flexibility, the toner scooper 120*b* is able to rotate so as to move slidingly along the inner wall of the toner container 121 while undergoing deformation, thereby scooping up the unused toner.

The toner discharge portion 122 is a member for supplying the unused toner stored in the toner container 121 to the developing device 2 through the toner discharge port 121*a*. The toner discharge portion 122 comprises a screw auger including a screw blade 122*a* and a rotary shaft 122*b*, and a rotary gear 122*c*. In FIG. 5, the toner discharge portion 122 is illustrated as being driven to rotate clockwise, through the rotary gear 122*c*, by a toner discharge portion driving portion (not shown). The orientation of the screw auger is so determined that the unused toner present in the vicinity of each axial end of the rotary shaft 122*b* can be conveyed properly to the toner discharge port 121*a* under the rotation of the toner discharge portion 122.

The toner discharge portion partition wall 123 is disposed between the toner discharge portion 122 and the toner stirring portion 120. The toner discharge portion partition wall 123 acts to hold an adequate amount of the unused toner scooped up by the toner stirring portion 120 in the region near the toner discharge portion 122.

Now, a description will be given as to how the developing device 2 and the toner replenishing section 22 take part in the image forming operation. In effecting image formation, in the developing device 2, the two-component developer stored in the developer tank 111 is conveyed with stirring by the first and second conveying portions 112 and 113, and is then borne on the developing roller 114 so that the toner can be supplied to the photoreceptor drum 3. The toner replenishing section 22 replenishes the developer tank 111 with the unused toner according to the consumption of the toner present therein. Concrete explanations will be set forth hereunder.

The first conveying portion 112 and the second conveying portion 113 are each rotatably driven by the first conveying portion driving portion and the second conveying portion driving portion, respectively. As the first conveying portion 112 is rotatably driven, in the first conveyance passage P, the two-component developer is stirred and conveyed to travel in the direction of the arrow X, passes through the first communication passage a, and is conveyed to enter the second conveyance passage Q. Moreover, as the second conveying portion 113 is rotatably driven, in the second conveyance passage Q, the two-component developer is stirred and conveyed to travel in the direction of the arrow Y, passes through the second communication passage b, and is conveyed to enter the first conveyance passage P. That is, the first conveying portion 112 and the second conveying portion 113 convey the two-component developer in opposite directions. Under such a stirring-conveying action of the first and second conveying portions 112 and 113, in the developer tank 111, the two-component developer is passed in circulation through the first conveyance passage P, the first communication passage a, the second conveyance passage Q, and the second communication passage b in the following order: the first conveyance passage P, the first communication passage a, the second conveyance passage Q, the second communication passage b, and the first conveyance passage P.

The developing roller 114 binds and bear the two-component developer being conveyed in the second conveyance passage Q thereon under the action of the magnet roller disposed thereinside. As the developing roller 114 is rotatably driven, the two-component developer borne on its surface is scooped up so that the toner contained in the two-component developer can be supplied to the photoreceptor drum 3. In this way, the toner stored in the developer tank 111 is consumed little by little.

In accordance with the amount of toner consumption, the toner replenishing section 22 replenishes the first conveyance passage P with a predetermined amount of the unused toner through the toner supply port 115*a*. The unused toner replenished is mixed with the two-component developer remaining in the first conveyance passage P, and is then conveyed with stirring in the manner thus far described.

Next, the cleaning mode will be described below. The image forming apparatus 100 has, in addition to the aforestated image forming functions, a cleaning mode that is the function of cleaning the developing device 2. In the developing device 2 placed in the cleaning mode, the first conveying portion 112 having the first screw blade 112*a* containing the ferromagnetic substance and the second conveying portion 113 having the second screw blade 113*a* containing the ferromagnetic substance are magnetized, and the two-component developer composed of the toner and the magnetic carrier stored in the developer tank 111 is stirred by the first and second conveying portions 112 and 113 in a magnetized state.

Figure 7:
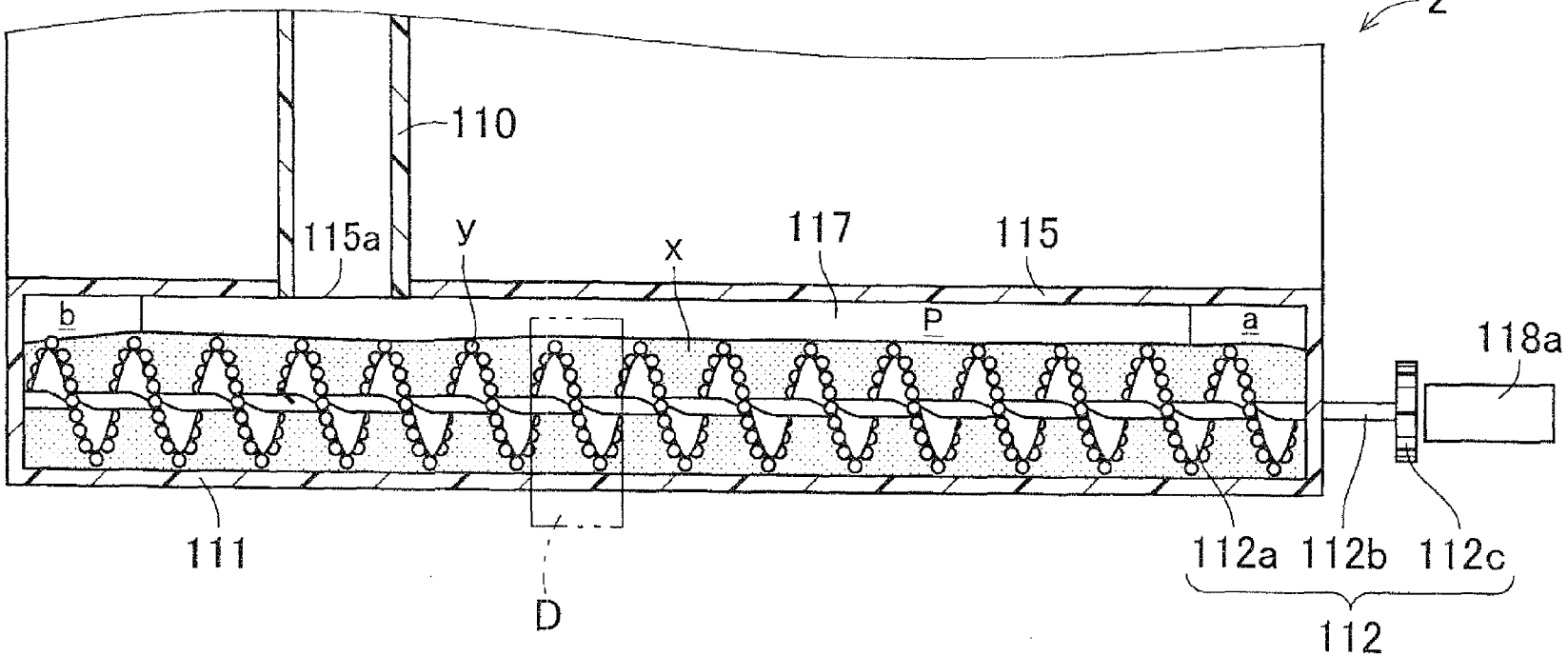
FIG. 7 is a view for explaining a cleaning mode for the developing device.
Figure 8:
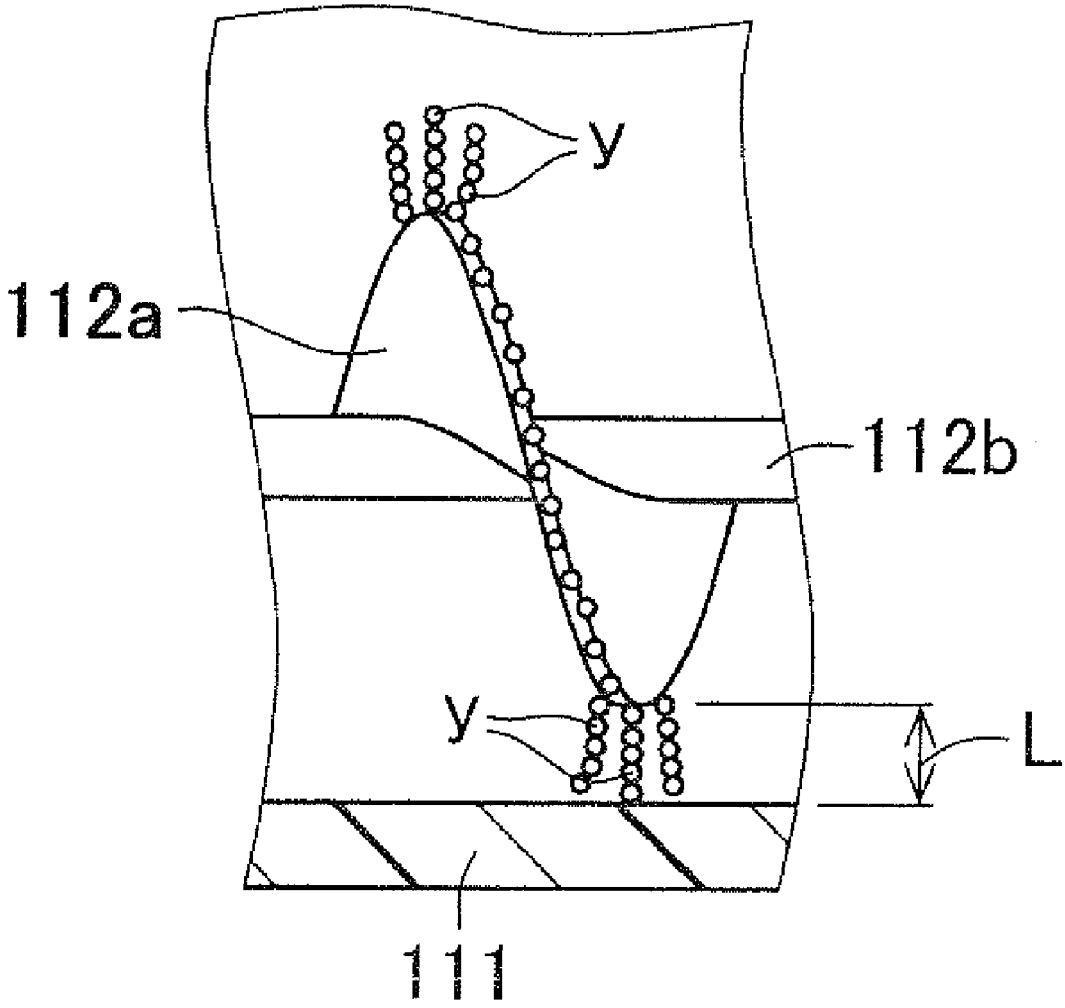
FIG. 8 is an enlarged schematic view of part of the developing device indicated by a symbol D depicted in FIG. 7.

That is, the cleaning method pursuant to the invention can be carried out by the cleaning mode. FIG. 7 is a view for explaining the cleaning mode for the developing device 2. Moreover, FIG. 8 is an enlarged schematic view of part of the developing device 2 indicated by the symbol D depicted in FIG. 7.

In response to an instruction from a user to establish the cleaning mode, or at predetermined times such as just moments before the start of image formation, the developing device 2 is shifted to the cleaning mode. In the developing device 2 placed in the cleaning mode, electric current is applied to the first and second electromagnets 118*a* and 118*b* to produce a magnetic field, thereby magnetizing the first and second screw blades 112*a* and 113*a*. As shown in FIG. 7, the first screw blade 112*a* in a magnetized state attracts the magnetic carrier contained in the two-component developer x stored in the developer tank 111 and causes it to bind thereon. As shown in FIG. 8, the magnetic carrier bound on the first screw blade 112*a* forms a magnetic brush y at the radial end part thereof. Similarly, the magnetic brush y is also formed at the radial end part of the second screw blade 113*a*. It is preferable that a length L of the magnetic brush y formed in an ear-like shape falls within a range of 0.5 mm or more and 2 mm or less. It is also preferable that the line density of a number of the magnetic brush y pieces at the radial end part falls within a range of 50 mT or more and 150 mT or less.

The developing device 2 performs the aforestated stirring-conveying operation, with the first and second screw blades 112*a* and 113*a* kept in a magnetized state. That is the first and second screw blades 112*a* and 113*a* are rotatably driven in a magnetic brush y-carrying state. With the provision of such a cleaning mode, in the developing device 2, the developer adhering in an aggregated state to the inner wall of the developer tank 111 can be rubbed off by the magnetic brush with the consequence that cleaning of the inner wall of the developer tank 111 can be achieved without the necessity of disposing an extra member within the developer tank 111. This makes it possible to remove the developer adhering in an aggregated state to the inner wall of the developer tank 111 at any time, and thereby maintain satisfactory developer conveyance capability. Accordingly, the developing device 2 succeeds in preventing lack of uniformity in image density. Moreover, in the developing device 2, since the developer adhering in an aggregated state around the toner density detecting sensor 119 can also be removed, it never occurs that the toner density detecting sensor 119 makes erroneous detection of toner density. Accordingly, the developing device 2 succeeds in exercising toner density control with stability.

it is preferable that, in the cleaning mode, the rotational speed of the first rotary shaft 112*b* as well as the second rotary shaft 113*b* falls within a range of 60 rpm or more and 120 rpm or less. In the developing device 2 placed in the cleaning mode, the inner wall of the developer tank 111 can be cleaned out thoroughly in so far as the rotational speed is 60 rpm or more. Moreover, the cleaning operation can be carried out while suppressing quality degradation of the magnetic carrier in so far as the rotational speed is 120 rpm or less.

Moreover, in the developing device 2, no electric current will be applied to the first and second electromagnets 118*a* and 118*b* and thus none of the first and second screw blades 112*a* and 113*a* will be magnetized unless the cleaning mode is established. Therefore, during the time the cleaning mode remains at rest, in the developing device 2, the magnetic carrier is not constrained and is thus not subjected to any stress. Further, in the developing device 2, as compared with the case where the cleaning mode is in working order, in the case where the cleaning mode remains at rest, the strength of the force of magnetic carrier constraint exerted by the first and second screw blades 112*a* and 113*a* is decreased. This makes it possible to achieve stirring and conveyance of the two-component developer with efficiency.

Moreover, in the developing device 2, the first and second screw blades 112*a* and 113*a* are each so shaped that the radial end part thereof has a pointed front end, the front end face of which ranges in width from 0.5 mm to 1 mm. Accordingly, the magnetic brush y is readily formed so as to extend in the radial direction, thereby enhancing the effect of cleaning the inner wall of the developer tank 111.

Moreover, as has already been described, in the developing device 2, the first electromagnet 118*a* disposed only in the region near one end of the first rotary shaft 112*b* and the second electromagnet 118*b* disposed only in the region near one end of the second rotary shaft 113*b* act to produce a magnetic field. In this regard, the magnetizing section such as a magnet to be disposed in each of the first and second conveying portions 112 and 113 may alternatively be placed in a region other than the region near one end of the first rotary shaft 112*b* as well as the second rotary shaft 113*b*, for example, it may be placed inside the first screw blade 112*a* as well as the second screw blade 113*a* or may be placed on the inner wall of the developer tank 111. However, just like the developing device 2 of the present embodiment, in the case where the magnetizing section is placed only in the region near one end of the rotary shaft, the magnetic field applied to the first screw blade 112*a* as well as the second screw blade 113*a* is impervious to being cancelled, with consequent easy magnetization of the first and second screw blades 112*a* and 113*a*. Accordingly, in the developing device 2, the number of magnets for use can be reduced, or the magnet can be downsized, with consequent miniaturization of the developing device 2. Moreover, in the developing device 2, since the first and second screw blades 112*a* and 113*a* are magnetized by the magnets disposed only in the region near one end of the first rotary shaft 112*b* and in the region near one end of the second rotary shaft 113*b*, respectively, it follows that the magnetic flux density at the radial end part of the first screw blade 112*a* can be made higher than that in the vicinity of the first rotary shaft 112*b*, and likewise the magnetic flux density at the radial end part of the second screw blade 113*a* can be made higher than that in the vicinity of the second rotary shaft 113*b*. This makes it possible to render the resultant magnetic brush y pieces uniform, thereby enhancing the effect of cleaning the developer tank 111. The reason why the magnetic flux density at the radial end part is higher than the magnetic flux density in the vicinity of the rotary shaft is as follows. In the absence of the ferromagnetic substance, the magnetic flux spreads out radially from the magnetic pole. The magnetic flux density (magnetic force) varies so as to be inversely proportional to the square of the distance, and is lowered with decreasing proximity to the magnet. However, in the presence of the ferromagnetic substance just like the present embodiment, the magnetic flux is concentrated onto the ferromagnetic substance and spreads out into space from the front end of the ferromagnetic substance. More preferably, the magnet is so placed that a straight line segment connecting the opposite magnetic poles of the magnet runs in parallel with the axis of rotation of the stirring portion. By doing so, the magnetic flux density at the radial end part of the screw blade can be increased with the consequence that the cleaning operation can be achieved more effectively.

Moreover, as has already been described, in the developing device 2, the first and second conveying portions 112 and 113 are magnetized by the first and second electromagnets 118*a* and 118*b*, respectively. The magnet provided for each of the first and second conveying portions 112 and 113 may be a permanent magnet. Moreover, the switching section may be constructed of a mechanism for changing the distance between the permanent magnet and the first rotary gear 112*c* as well as the second rotary gear 113*c* or a magnetic-field cutoff member which is movable between the permanent magnet and the first rotary gear 112*c* as well as the second rotary gear 113*c*. However, just like the developing device 2 of the present embodiment, by the use of the first and second electromagnets 118*a* and 118*b*, in contrast to the case where the first and second conveying portions 112 and 113 are each magnetized by the permanent magnet, it is possible to perform switching between the state where the magnetic field produced by the magnet is applied to the first and second conveying portions 112 and 113 and the state where no magnetic field is applied thereto with a simple mechanism. Accordingly, the developing device 2 can be made more compact with use of the first and second electromagnets 118*a* and 118*b* as the magnetizing section.

Moreover, as has already been described, in the developing device 2, the ferrite particles contained in the first and second screw blades 112*a* and 113*a* exhibit small remanent magnetization. Therefore, when the application of electric current to the first and second electromagnets 118*a* and 118*b* is stopped, then the first and second screw blades 112*a* and 113*a* lose the force of magnetic carrier constraint. That is, in the developing device 2, by decreasing the magnetic field applied to the first and second screw blades 112*a* and 113*a*, it is possible to swiftly free the magnetic carrier from the constraint of the first and second screw blades 112*a* and 113*a*, and thereby rotate the first and second screw blades 112*a* and 113*a* without causing the magnetic carrier to bind thereon. Accordingly, during the stirring-conveying operation with the cleaning mode kept at rest, the stress occurring in the two-component developer can be reduced, wherefore the two-component developer can be prevented from having a short service life. Moreover, during the time the cleaning mode remains at rest, in the developing device 2, the first and second screw blades 112*a* and 113*a* lose the force of magnetic carrier constraint. This makes it possible to achieve stirring and conveyance of the two-component developer with efficiency.

Moreover, as has already been described, in the developing device 2, the first and second rotary shafts 112*b* and 113*b* are each made of a metal material and thus exhibit high rigidity. Therefore, in the developing device 2, the first and second rotary shafts 112*b* and 113*b* are resistant to deformation and can thus be used for a longer period of time. Further, because of the small remanent magnetization of the first and second rotary shafts 112*b* and 113*b*, the first and second screw blades 112*a* and 113*a* can be magnetized evenly as a whole. Therefore, even in a part of the first screw blade 112*a* which is located relatively away from the first electromagnet 118*a*, and likewise in a part of the second screw blade 113*a* which is located relatively away from the second electromagnet 118*b*, the magnetic brush can be formed with stability. By virtue of the stable formation of the magnetic brush y, in the developing device 2, the developer tank 111 can be cleaned out more thoroughly. Note that, when the remanent magnetization of the rotary shaft is small, the screw blade can be magnetized evenly. This is because, since no magnetization remains on the rotary shaft, when the rotary shaft is magnetized, the magnetization in different sections of the rotary shaft can be rendered uniform at all times.

In addition, because of the small remanent magnetization of the first and second rotary shafts 112*b* and 113*b*, when the developing device is changed to the state where no magnetic field is applied to the first and second rotary shafts 112*b* and 113*b*, then the first and second screw blades 112*a* and 113*a* are swiftly brought into a non-magnetized state, thus freeing the magnetic carrier from the constraint of the first and second screw blades 112*a* and 113*a*. Accordingly, during the time the cleaning mode remains at rest, in the developing device 2, the first and second conveying portions 112 and 113 can be rotated without constraining the magnetic carrier. This makes it possible to reduce the stress occurring in the developer at the time of rotating the first and second conveying portions 112 and 113, and thereby prevent the developer from having a short service life. Meanwhile, if the remanent magnetization of the first and second rotary shafts 112*b* and 113*b* is large, even if the developing device is changed to the state where no magnetic field is applied to the first and second rotary shafts 112*b* and 113*b*, the two-component developer containing the magnetic carrier is constrained by the first and second rotary shafts 112*b* and 113*b*. This leads to poor flowability of the two-component developer containing the magnetic carrier and thus to an undesirable increase in the stress on the developer.

Moreover, as has already been described, in the developing device 2, the first and second screw blades 112*a* and 113*a* are each made of resin. Accordingly, the developing device 2 can include the first and second screw blades 112*a* and 113*a* having a complicated shape, thereby enhancing the effect of cleaning the developer tank 111.

Moreover, as has already been described, by way of another embodiment, the first screw blade 112*a* and the first rotary shaft 112*b* are formed integrally with each other by using a metal material, and the second screw blade 113*a* and the second rotary shaft 113*b* are formed integrally with each other by using a metal material, too. Therefore, each of the first and second conveying portions 112 and 113 exhibits high rigidity and can be made more compact. Accordingly, the developing device of the present embodiment can be used for a longer period of time, and also, by making the developer tank 111 more compact, it is possible to reduce the size of the device as a whole. Moreover, in the developing device of the present embodiment, since the first and second screw blades 112*a* and 113*a* are each made of a metal material which exhibits small remanent magnetization, during the stirring-conveying operation with the cleaning mode kept at rest, the stress occurring in the two-component developer can be reduced, wherefore the two-component developer can be prevented from having a short service life. Further, in the developing device of the present embodiment, being made of a metal material which exhibits small remanent magnetization, each of the first and second screw blades 112*a* and 113*a* can be magnetized evenly as a whole. Therefore, even in a part of the first screw blade 112*a* which is located relatively away from the first electromagnet 118*a*, as well as in a part of the second screw blade 113*a* which is located relatively away from the second electromagnet 118*b*, the magnetic brush y can be formed with stability, thereby enhancing the effect of cleaning the developer tank 111.

As described heretofore, in the developing device 2, it is possible to remove the developer adhering to the inner wall of the developer tank 111 and thereby maintain satisfactory developer conveyance capability. Accordingly, the image forming apparatus 100 provided with the developing device 2 succeeds in preventing lack of uniformity in image density.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A developing device comprising;

a developer containing section for storing therein a two-component developer including toner and magnetic carrier;

a developer conveying section comprising a rotary shaft and a screw blade containing a ferromagnetic substance that is so formed as to extend in a spiral fashion around the rotary shaft and to rotate together with the rotary shaft;

a magnetizing section for magnetizing the screw blade, wherein the magnetizing section is constructed of an electromagnet disposed only in a region near one end of the rotary shaft; and a switching section that performs switching between a state where a magnetic field produced by the magnetizing section is applied to the screw blade and a state where no magnetic field is applied to the screw blade, wherein the switching section is constructed of a power source for applying electric current to the electromagnet.

2. The developing device of claim 1, wherein the ferromagnetic substance exhibits small remnant magnetization.

3. The developing device of claim 2, wherein the remnant magnetization of the ferromagnetic substance falls within a range of 0 $Wb/m^2$ or more and 0.5 $Wb/m^2$ or less.

4. The developing device of claim 1, wherein the rotary shaft is made of a metal material which exhibits small remnant magnetization.

5. The developing device of claim 4, wherein the metal material which exhibits small remnant magnetization is a nickel-iron alloy.

6. The developing device of claim 1, wherein the screw blade and the rotary shaft are formed integrally with each other by using a metal material which exhibits small remnant magnetization.

7. The developing device of claim 6, wherein the metal material which exhibits small remnant magnetization is a nickel-iron alloy.

8. A developing device, comprising:

a developer containing section for storing therein a two-component developer including toner and magnetic carrier;

a developer conveying section comprising a rotary shaft and a screw blade containing a ferromagnetic substance that is so formed as to extend in a spiral fashion around the rotary shaft and to rotate together with the rotary shaft, wherein the screw blade is made of a resin containing ferrite particles as the ferromagnetic substance; and a magnetizing section for magnetizing the screw blade.

9. An image forming apparatus comprising the developing device of claim 1.

10. A cleaning method for a developing device comprising:

magnetizing a developer conveying section having a rotary shaft and a screw blade containing a ferromagnetic substance, wherein the developer conveying section is magnetized by an electromagnet disposed only in a region near one end of the rotary shaft; and stirring a two-component developer including toner and magnetic carrier stored in a developer containing section by the developer conveying section in a magnetized state.

11. A cleaning method for a developing device, comprising:

magnetizing a developer conveying section having a screw blade containing a ferromagnetic substance, wherein the screw blade is made of a resin containing ferrite particles as the ferromagnetic substance; and stirring a two-component developer including toner and magnetic carrier stored in a developer containing section by the developer conveying section in a magnetized state.

* * * * *